US009332818B2

(12) United States Patent
Holloway

(10) Patent No.: US 9,332,818 B2
(45) Date of Patent: May 10, 2016

(54) DOUBLE-ENDED COSMETIC DISPENSER

(71) Applicant: Thomas F. Holloway, Essex, MD (US)

(72) Inventor: Thomas F. Holloway, Essex, MD (US)

( * ) Notice: Subject to any disclaimer, the term of this patent is extended or adjusted under 35 U.S.C. 154(b) by 49 days.

(21) Appl. No.: 14/466,698

(22) Filed: Aug. 22, 2014

(65) Prior Publication Data

US 2015/0055997 A1 Feb. 26, 2015

Related U.S. Application Data

(60) Provisional application No. 61/868,941, filed on Aug. 22, 2013.

(51) Int. Cl.
*A45D 40/24* (2006.01)
*A45D 40/04* (2006.01)

(52) U.S. Cl.
CPC ..... *A45D 40/24* (2013.01); *A45D 40/04* (2013.01)

(58) Field of Classification Search
None
See application file for complete search history.

(56) References Cited

U.S. PATENT DOCUMENTS

| | | | |
|---|---|---|---|
| 1,153,055 | A | 9/1915 | Fuller |
| 1,244,798 | A | 10/1917 | Tharp et al. |
| 1,623,509 | A | 4/1927 | Vivaudou |
| 2,029,731 | A | 2/1936 | Maurer |
| 2,142,312 | A | 1/1939 | Heinz |
| 2,264,482 | A | 12/1941 | Ridner, Sr. et al. |
| 2,573,828 | A | 11/1951 | Braselton |
| 2,636,598 | A | 4/1953 | Hopgood |
| 2,710,614 | A | 6/1955 | Dulberg |
| 2,815,122 | A | 12/1957 | Lerner et al. |
| 3,001,531 | A | 9/1961 | Gazdik |
| 3,320,962 | A | 5/1967 | Moriber et al. |
| 4,029,422 | A | 6/1977 | Pillsbury |
| 4,428,388 | A | 1/1984 | Cassai et al. |
| 4,562,923 | A | 1/1986 | Katada et al. |
| 4,666,043 | A | 5/1987 | Tahara |
| 4,671,689 | A | 6/1987 | Gueret |
| 4,687,364 | A | 8/1987 | Kingsford |
| 4,692,046 | A | 9/1987 | Lan |
| 4,778,300 | A | 10/1988 | French et al. |
| 4,838,722 | A | 6/1989 | Katz |
| 5,026,190 | A | 6/1991 | Longarzo |

(Continued)

FOREIGN PATENT DOCUMENTS

| | | |
|---|---|---|
| FR | 0979157 | 12/1950 |
| FR | 1271920 | 10/1960 |

(Continued)

*Primary Examiner* — David Walczak
(74) *Attorney, Agent, or Firm* — Thomas P. O'Connell; O'Connell Law Firm

(57) ABSTRACT

A double-ended cosmetic dispenser with an adaptor sleeve, a first cosmetic sleeve rotatably retained relative to a first end of the adaptor sleeve, and a second cosmetic sleeve rotatably retained relative to a second end of the adaptor sleeve. First and second cosmetic elevators, each with an elevator stem and a cosmetic retaining portion, are extendably and retractably received by the respective cosmetic sleeves and into the adaptor sleeve. The cosmetic elevators are fixed against rotation relative to the cosmetic sleeves. The elevator stem of the first cosmetic elevator has an open inner volume, and the proximal end of the elevator stem of the second cosmetic elevator is received into that open inner volume. Through thread structures, the cosmetic elevators are independently and selectively extendable and retractable relative to the first and second cosmetic sleeves by a rotation of the respective cosmetic sleeve in relation to the adaptor sleeve.

8 Claims, 11 Drawing Sheets

(56) References Cited

U.S. PATENT DOCUMENTS

| | | | | |
|---|---|---|---|---|
| 5,109,877 | A | 5/1992 | Takeda | |
| 5,172,993 | A | 12/1992 | Ackermann et al. | |
| 5,186,560 | A | 2/1993 | Holloway | |
| 5,186,561 | A | 2/1993 | Ackermann et al. | |
| 5,301,808 | A | 4/1994 | Pierson | |
| 5,306,107 | A * | 4/1994 | Kageyama | B43K 23/124 401/29 |
| 5,324,126 | A | 6/1994 | Holloway et al. | |
| 5,332,325 | A | 7/1994 | Crosnier et al. | |
| 5,348,410 | A | 9/1994 | Shozi et al. | |
| 5,349,972 | A | 9/1994 | Dirksing et al. | |
| 5,597,254 | A | 1/1997 | Vasas | |
| 5,715,848 | A | 2/1998 | Conley, Jr. | |
| 5,791,799 | A | 8/1998 | Oehlhorn | |
| 5,791,800 | A | 8/1998 | Katz | |
| 5,851,078 | A | 12/1998 | Bow et al. | |
| 5,927,881 | A | 7/1999 | Yang | |
| 5,951,186 | A | 9/1999 | Lhuisset | |
| 6,010,265 | A | 1/2000 | Bouix | |
| 6,200,047 | B1 | 3/2001 | Holloway | |
| 6,200,049 | B1 | 3/2001 | Pinhel et al. | |
| 6,231,254 | B1 | 5/2001 | Holloway | |
| 6,231,256 | B1 | 5/2001 | Kingsford et al. | |
| 6,371,129 | B1 | 4/2002 | Le Bras-Brown et al. | |
| 6,375,374 | B2 | 4/2002 | Gueret | |
| 6,412,999 | B1 | 7/2002 | Pierpont | |
| 6,540,422 | B2 | 4/2003 | Torii | |
| 6,543,953 | B1 | 4/2003 | Kim | |
| 6,718,990 | B1 | 4/2004 | Chastain et al. | |
| 6,895,628 | B1 | 5/2005 | Anderson | |
| 7,175,359 | B2 * | 2/2007 | Zhang | A45D 40/205 401/172 |
| 7,237,973 | B1 | 7/2007 | Lou | |
| 2004/0184865 | A1 | 9/2004 | Carroll | |
| 2006/0216103 | A1 | 9/2006 | Bielecki et al. | |
| 2007/0280772 | A1 | 12/2007 | Mika | |
| 2008/0166172 | A1 | 7/2008 | Eng et al. | |

FOREIGN PATENT DOCUMENTS

| | | |
|---|---|---|
| FR | 2869206 | 10/2005 |
| FR | 2869206 A1 | 10/2005 |
| FR | 2900547 | 11/2007 |
| FR | 2906114 | 3/2008 |
| GB | 2161788 | 1/1986 |
| WO | WO03015567 | 2/2003 |
| WO | WO2005032301 | 4/2005 |

* cited by examiner

DOUBLE-ENDED COSMETIC DISPENSER

FIELD OF THE INVENTION

The present invention relates generally to cosmetic dispensers. More particularly, disclosed herein is a double-ended cosmetic dispenser for selectively dispensing first and second cosmetics, such as but not limited to cosmetic pomades, in an efficient and compact construction.

BACKGROUND OF THE INVENTION

In a typical prior art lipstick dispenser, an elevator cup retains a pomade of lipstick for axial extension and retraction by a swiveling of a base portion in relation to a body portion of the dispenser. Dispensers have commonly employed what is referred to as a cam member with helical threads formed therealong that is rotatably associated with a tubular innerbody. The innerbody is normally formed with opposed longitudinal tracks. The elevator cup typically has opposed lugs that are received through the longitudinal track to engage the helical threads of the cam member. Under this arrangement, a rotation of the cam member in relation to the tubular innerbody induces the desired axial movement of the elevator cup and the retained lipstick pomade as the lugs of the elevator cup slide along the helical threads and the longitudinal tracks.

Prior art inventors have also proposed arrangements for extending and retracting first and second cosmetics, such as lipstick pomades, in a double-ended configuration. Under prior art constructions, however, a significant multiplicity of components has been necessary to extend and retract first and second cosmetics. Moreover, the number of components required in prior art double-ended dispensers and their necessary dispositions and relationships have typically produced double-ended cosmetic dispensers that are undesirably bulky and unwieldy.

With a knowledge of the state of the art as summarized above, the present inventor has appreciated that there is a need for a double-ended cosmetic dispenser that is operative to extend and retract first and second cosmetics independently with a reduced number of required components and that is capable of achieving a more efficient, compact, and manageable dispenser.

SUMMARY OF THE INVENTION

The present invention thus has as its most broadly stated object the providing of a double-ended dispenser for cosmetics, such as lipsticks, that represents an advance and improvement over prior art double-ended cosmetic dispensers by reducing the number of necessary components while demonstrating a concomitant improvement in design and operation efficiencies.

A related object of embodiments of the invention is to provide a double-ended cosmetic dispenser that can be carried forth with comparative reductions in necessary length, diameter, and overall size.

Another object of the invention is to provide a double-ended cosmetic dispenser wherein first and second cosmetics can be extended and retracted selectively and independently.

Still another object of embodiments of the invention is to provide a double-ended cosmetic dispenser that conserves materials and is relatively efficient in construction, assembly, and operation.

These and further objects and advantages of embodiments of the invention will become obvious not only to one who reviews the present specification and drawings but also to one who has an opportunity to make use of an embodiment of the double-ended cosmetic dispenser disclosed herein. It will be appreciated, however, that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the invention.

In carrying forth one or more objects of the invention, an embodiment of the double-ended cosmetic dispenser can be considered to be founded on an adaptor sleeve with a first end portion and a second end portion. A first cosmetic sleeve is rotatably retained relative to the first end portion of the adaptor sleeve, and a second cosmetic sleeve is rotatably retained relative to the second end portion of the adaptor sleeve. A first cosmetic elevator has an elevator stem with a proximal end and a distal end and a cosmetic retaining portion retained at the distal end of the elevator stem. The elevator stem of the first cosmetic elevator is extendably and retractably received by the first cosmetic sleeve and into the first end portion of the adaptor sleeve, and the first cosmetic elevator is fixed against rotation relative to the first cosmetic sleeve. The second cosmetic elevator also has an elevator stem with a proximal end and a distal end and a cosmetic retaining portion retained at the distal end of the elevator stem. The elevator stem of the second cosmetic elevator is extendably and retractably received by the second cosmetic sleeve and into the second end portion of the adaptor sleeve, and the second cosmetic elevator is fixed against rotation relative to the second cosmetic sleeve. The elevator stem of the first cosmetic elevator has an open inner volume, and the proximal end of the elevator stem of the second cosmetic elevator is received into the open inner volume of the elevator stem of the first cosmetic elevator. The first cosmetic elevator is independently and selectively extendable and retractable relative to the first cosmetic sleeve by a rotation of the first cosmetic sleeve in relation to the adaptor sleeve, and the second cosmetic elevator is independently and selectively extendable and retractable relative to the second cosmetic sleeve by a rotation of the second cosmetic sleeve in relation to the adaptor sleeve.

In one practice of the invention, the first cosmetic elevator is independently and selectively extendable and retractable relative to the first cosmetic sleeve by a thread structure disposed on the elevator stem of the first cosmetic elevator in combination with a thread structure disposed on the elevator stem of the second cosmetic elevator. For instance, the thread structure disposed on the elevator stem of the first cosmetic elevator can comprise an internal thread structure, and the thread structure disposed on the elevator stem of the second cosmetic elevator comprises an external thread structure that cooperates with the internal thread structure disposed on the elevator stem of the first cosmetic elevator to convert relative rotation of the first cosmetic sleeve relative to the adaptor sleeve into longitudinal, linear movement of the first cosmetic elevator. While the thread structures could vary within the scope of the invention, it is possible for the internal thread structure disposed on the elevator stem of the first cosmetic elevator to comprise a helical thread structure, and the external thread structure disposed on the elevator stem of the second cosmetic elevator can take the form of at least one lug disposed on the elevator stem of the second cosmetic elevator. Moreover, the helical thread structure disposed on the elevator stem of the first cosmetic elevator can be disposed at a helical angle while the at least one lug disposed on the elevator stem of the second cosmetic elevator has opposed upper and lower surfaces that are disposed at an angle of attack approximately matching the helical angle of the helical thread structure disposed on the elevator stem of the first cosmetic elevator.

While other manifestations are possible, one embodiment of the invention has the first cosmetic elevator fixed against rotation relative to the first cosmetic sleeve by an alignment feature retained by the first cosmetic sleeve in combination with an alignment feature incorporated into the elevator stem of the first cosmetic elevator. Similarly, the second cosmetic elevator can be fixed against rotation relative to the second cosmetic sleeve by an alignment feature retained by the second cosmetic sleeve in combination with an alignment feature incorporated into the elevator stem of the second cosmetic elevator. For instance, the alignment feature retained by the first cosmetic sleeve can comprise a non-circular adaptor aperture, and the alignment feature incorporated into the elevator stem of the first cosmetic sleeve can comprise a non-circular cross section of the elevator stem corresponding to the non-circular adaptor aperture of the first cosmetic sleeve in cross-sectional shape and size. Likewise, the alignment feature retained by the second cosmetic sleeve can comprise a non-circular adaptor aperture, and the alignment feature incorporated into the elevator stem of the second cosmetic sleeve can be a non-circular cross section of the elevator stem corresponding to the non-circular adaptor aperture of the second cosmetic sleeve in cross-sectional shape and size. By way of example and not limitation, the adaptor apertures and the elevator stems could have opposed flat sides and interposed annular segments.

Further embodiments of the double-ended cosmetic dispenser are contemplated wherein the first cosmetic elevator is independently and selectively extendable and retractable relative to the first cosmetic sleeve by a thread structure disposed on the elevator stem of the first cosmetic elevator in combination with a first thread structure disposed on the adaptor sleeve. The second cosmetic elevator can be independently and selectively extendable and retractable relative to the second cosmetic sleeve by a thread structure disposed on the elevator stem of the second cosmetic elevator in combination with a second thread structure disposed on the adaptor sleeve.

As taught herein, the elevator stems of the first and second cosmetic elevators can have different effective diameters, and the first and second thread structures disposed on the adaptor sleeves can have different effective diameters respectively corresponding to the effective diameters of the elevator stems of the first and second cosmetic elevators. The first thread structure can be disposed over a first portion of the adaptor sleeve, and the second thread structure, which can be different in size than the first thread structure, can be disposed over a second portion of the adaptor sleeve. By way of example and not limitation, the first and second thread structures disposed on the adaptor sleeve can be helical thread structures, which may or may not be continuous. The thread structure disposed on the elevator stem of the first cosmetic elevator could, by way of example and not limitation, comprise at least one lug. The lug can have opposed upper and lower surfaces disposed at an angle of attack approximately matching the helical angle of the first thread structure disposed on the adaptor sleeve.

In certain manifestations of the invention, the thread structure disposed on the elevator stem of the second cosmetic elevator can be a helical thread structure. The elevator stem of the second cosmetic elevator can have opposed flat sides and interposed annular segments. In such embodiments, the helical thread structure of the elevator stem of the second cosmetic elevator could be disposed substantially only over the annular segments of the elevator stem of the second cosmetic elevator.

One will appreciate that the foregoing discussion broadly outlines the more important features of the invention merely to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

The present invention for a double-ended cosmetic dispenser is subject to varied embodiments, each within the scope of the invention. However, to ensure that one skilled in the art will be able to understand and, in appropriate cases, practice the present invention, certain preferred embodiments of the broader invention revealed herein are described below and shown in the accompanying drawing figures.

Figure 1:
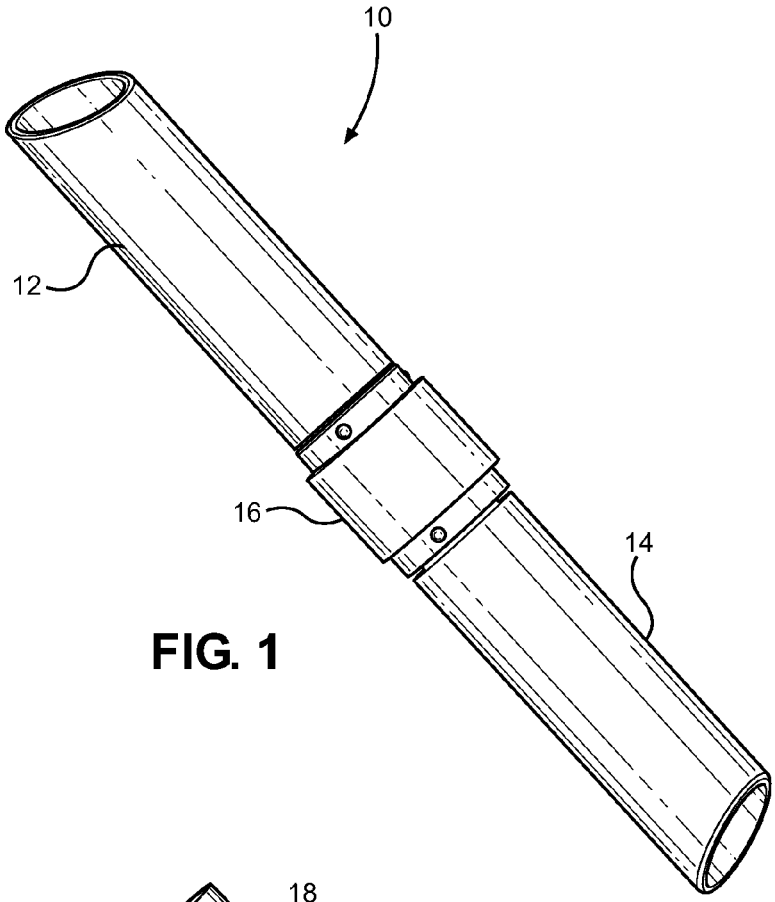
FIG. 1 is a perspective view of a double-ended cosmetic dispenser according to the present invention.

With this in mind and looking more particularly to the accompanying figures, an exemplary embodiment of a double-ended cosmetic dispenser pursuant to the present invention is indicated generally at 10 in FIG. 1. There, the cosmetic dispenser 10 can be seen to be founded on a center adaptor sleeve 16. A first cosmetic sleeve 12 is rotatably retained by the center adaptor sleeve 16 to project in a first direction that is aligned with a longitudinal axis of the cosmetic dispenser 10. Similarly, a second cosmetic sleeve 14 is retained by the center adaptor sleeve 16 to project in a second direction that is again aligned with the longitudinal axis of the cosmetic dispenser 10 and opposite the first direction.

In use, the double-ended cosmetic dispenser 10 can be actuated selectively to cause a first cosmetic applicator or cosmetic, such as a cosmetic pomade, to extend and retract in relation to the first cosmetic sleeve 12, and the double-ended cosmetic applicator 10 can be actuated selectively to cause a second cosmetic applicator or cosmetic, such as a cosmetic pomade, to extend and retract and relation to the second cosmetic sleeve 14. It will be appreciated that, except as it might expressly be by the claims, the invention is not limited with respect to the cosmetic to be retained and dispensed. While the double-ended cosmetic dispenser 10 has ready application to cosmetic pomades, such as pomades of lipstick, lip gloss, moisturizer, or the like, it is similarly possible for the retained cosmetic to be in fluid, gel, powder, or another form, and cosmetic applicators, such as bristled and non-bristled brushes, blades, cosmetic pencils, and other applicators could be readily retained for extension and retraction.

In practice, a first cap 34 can be selectively retained, such as by the center adaptor sleeve 16, to enshroud the first cosmetic sleeve 12 and the retained cosmetic, and a second cap 36 can be selectively retained, again by the center adaptor sleeve 16 or otherwise, to enshroud the second cosmetic sleeve 14 and the retained cosmetic. In the present embodiment, as can be seen most clearly with combined reference to FIGS. 1, 2, 10, and 11, the center adaptor sleeve 16 has a retaining feature in the form of a protuberance 46 to the first side thereof for retaining the first cap 34 in a removable, snap-fit engagement and a retaining feature in the form of a protuberance 48 to the second side thereof for retaining the second cap 36 in a removable, snap fit engagement. Of course, it would alternatively be possible for the caps 34 and 36 to be retained by threaded engagements or by any other effective method.

The first and second cosmetic sleeves 12 and 14 can be retained by the center adaptor sleeve 16 in any effective manner. In the present embodiment, the sleeves 12 and 14 matingly receive opposed rod-like projecting portions of the center adaptor sleeve 16. The sleeves 12 and 14 are engaged with the projecting portions of the center adaptor sleeve 16 in a snap-fit, rotatable engagement by annular retaining ridges 42 and 44 that encircle the projecting portions of the center adaptor sleeve 16 in combination with retaining rings 43 and 45 formed in the inner walls of the first and second cosmetic sleeves 12 and 14 adjacent to the proximal ends thereof. The first and second cosmetic sleeves 12 and 14 could be retained in any other effective manner within the scope of the invention.

It will again be appreciated that, while the presently depicted embodiment is configured to retain and dispense cosmetic pomades, such as pomades of lipstick or the like, the disclosed invention is readily applied to other cosmetics and cosmetic applicators, such as, but not limited to, mascara applicators, eyeliner applicators and pencils, and other cosmetics and cosmetic applicators. Indeed, the invention could readily be carried forth in relation to articles to be extended and retracted other than cosmetics, including, for example, writing implements and other articles.

Figure 2:
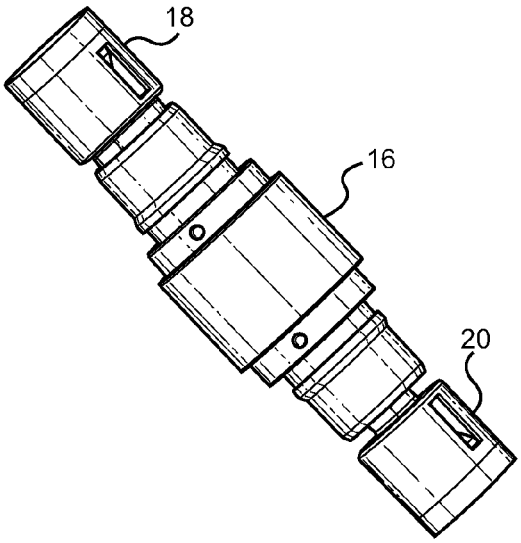
FIG. 2 is a perspective view of a center adaptor sleeve according to the invention retaining first and second, opposed elevators.
Figure 3:
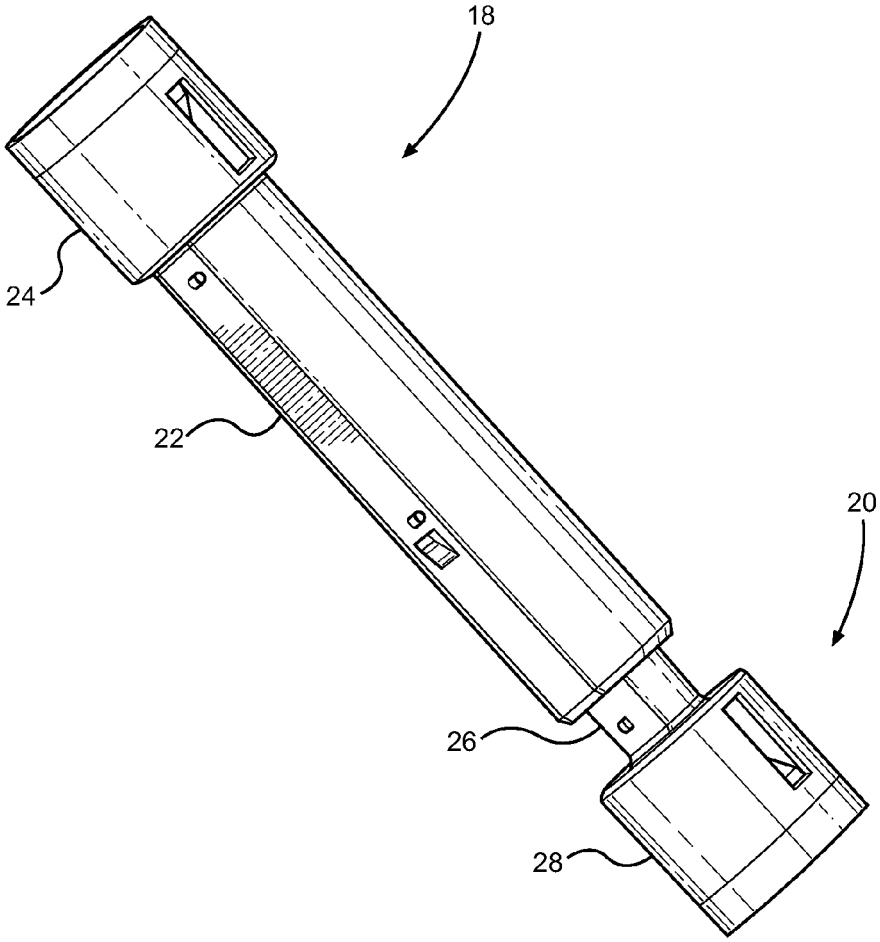
FIG. 3 is perspective view of the first and second elevators with the center adaptor sleeve removed for clarity.
Figure 4:
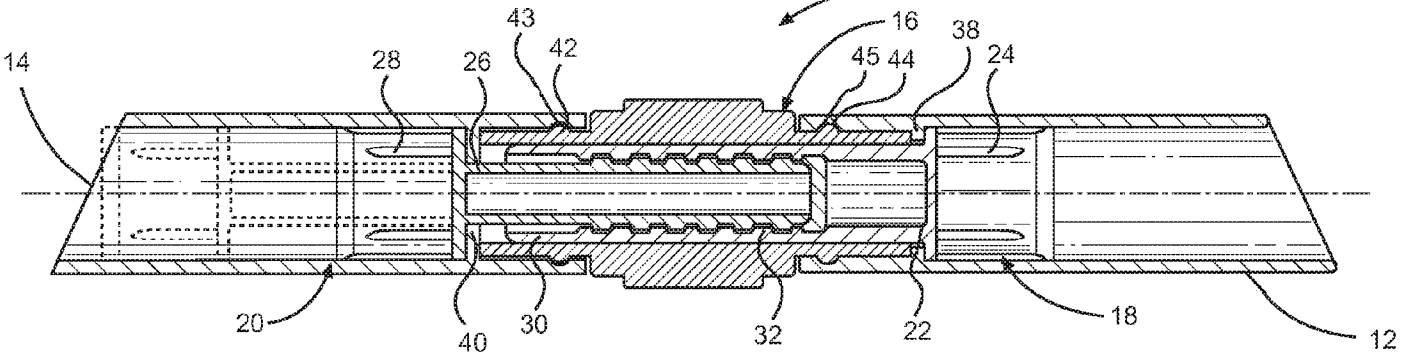
FIG. 4 is a longitudinal cross section of the double-ended cosmetic dispenser of FIG. 1.
Figure 5:
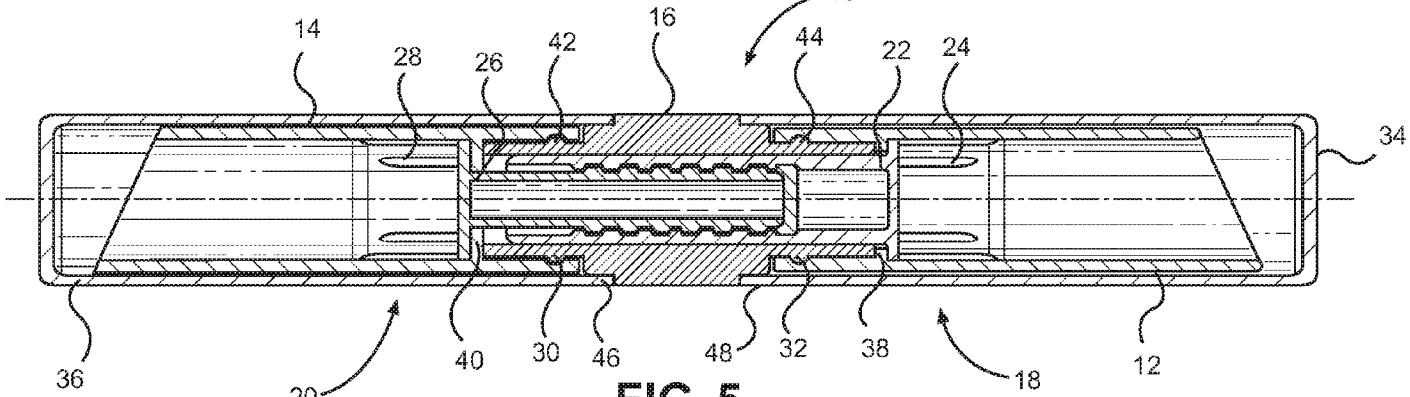
FIG. 5 is a longitudinal cross section of the double-ended cosmetic dispenser of FIG. 1 with caps applied to the first and second, opposed cosmetic dispensing sleeves.

Looking additionally to FIGS. 2 through 4, it can be seen that the center adaptor sleeve 16 extendably and retractably receives and retains a first elevator 18 that projects from the center adaptor sleeve 16 in the first direction. The center adaptor sleeve 16 also receives and retains a second elevator 20 that projects from the center adaptor sleeve 16 in the second direction.

The first elevator 18 has an elongate elevator stem 22 with a distal end that retains a cosmetic retaining portion, in this case an elevator cup 24 for retaining a cosmetic pomade (not shown), and a proximal end. Similarly, the second elevator 20 has an elongate elevator stem 26 with a distal end that retains a cosmetic retaining portion, again in this example an elevator cup 28 for retaining a cosmetic pomade (not shown), and a proximal end. As seen, for instance, in FIG. 8, a plurality of radial fins 52 project radially inward from the inner wall of the elevator cup 24 for engaging and retaining a cosmetic pomade relative to the first elevator 18. Similarly, a plurality of radial fins 50 project radially inward from the inner wall of the elevator cup 24 for engaging and retaining a cosmetic pomade relative to the second elevator 20 as shown, for instance, in FIG. 7.

The elevator stems 22 and 26 can be engaged in a mating relationship. For instance, the elevator stem 22 of the first elevator 18 can be tubular with a longitudinally communicating open inner volume. The elevator stem 26 of the second elevator 20 can thus be longitudinally received into the open inner volume of the elevator stem 22 of the first elevator 18. Of course, the stems 22 and 26 could readily be otherwise configured and disposed.

Figure 8:
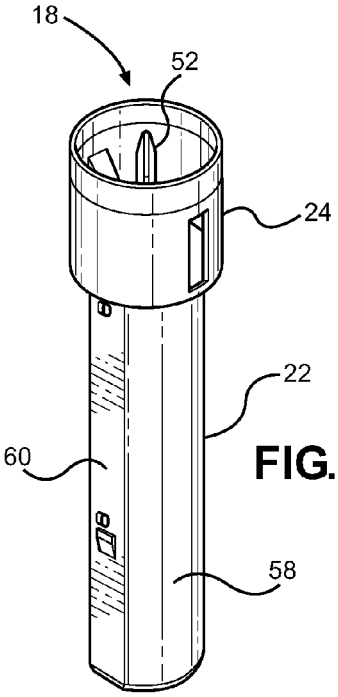
FIG. 8 is a perspective view of the second elevator for the double-ended cosmetic dispenser.
Figure 9:
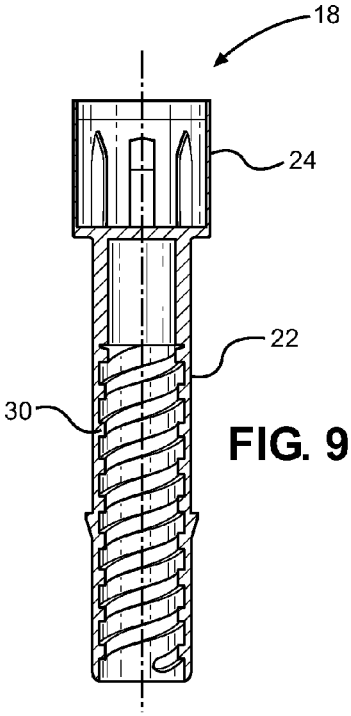
FIG. 9 is a longitudinal cross section of the second elevator.
Figure 10:
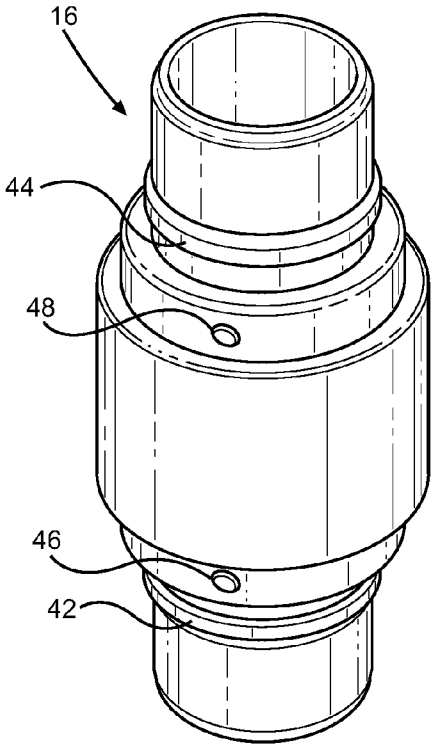
FIG. 10 is a perspective view of a center adaptor sleeve of the double-ended cosmetic dispenser.
Figure 11:
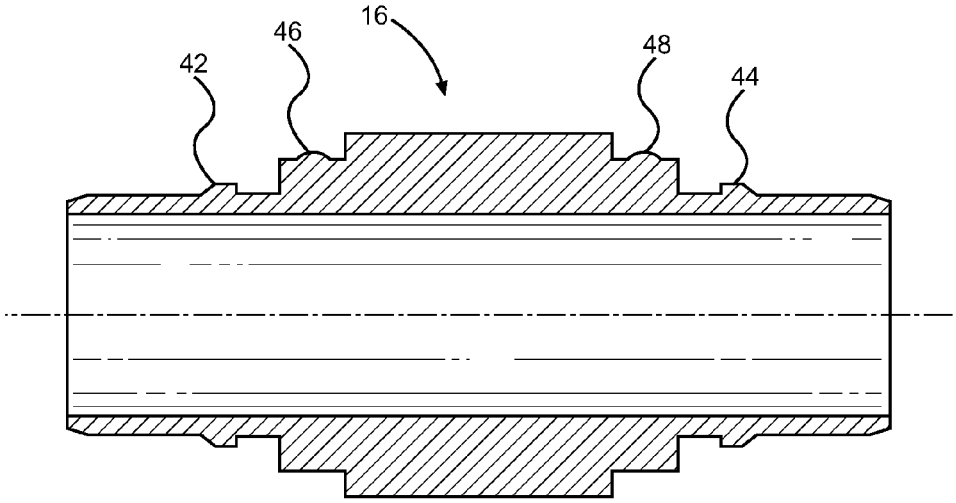
FIG. 11 is a longitudinal cross section of the center adaptor sleeve of FIG. 10.
Figure 12:
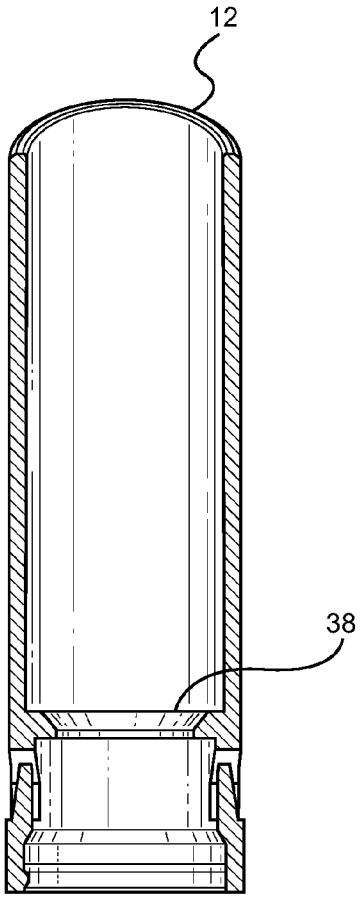
FIG. 12 is a longitudinal cross section of the first cosmetic sleeve.
Figure 13:
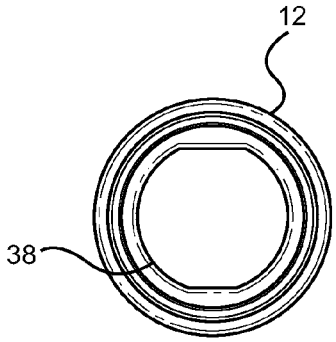
FIG. 13 is an end view of the first cosmetic sleeve.
Figure 14:
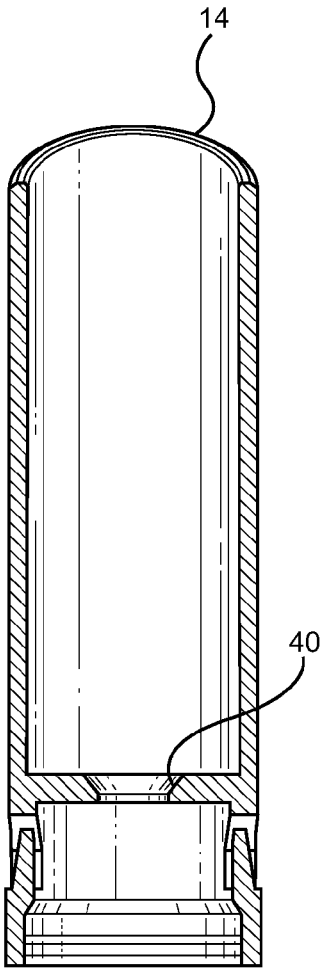
FIG. 14 is a longitudinal cross section of the second cosmetic sleeve.
Figure 15:
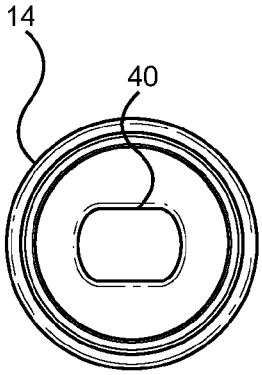
FIG. 15 is an end view of the second cosmetic sleeve.

With additional reference to FIGS. 8 and 9, the first elevator 18 can be seen to have a thread structure, more particularly helical threads 30, that communicate along the elevator stem 22. In this example, the helical threads 30 are internally disposed along an annular inner, tubular wall of the elevator stem 22. However, although it is not shown, it will be appreciated that helical threads 30 could alternatively be externally disposed along the outer wall of the elevator stem 22 or on the elevator stem 26 with the stem 22 or 26 retaining the helical threads 30 being received within the other elevator stem 26 or 22. Moreover, it would be possible for other thread structures, including thread portions or some other thread structure, to be employed.

As used herein, thread structures should be interpreted to include any structure used to convert rotational movement to linear movement. Except as the invention might be expressly limited by the claims, thread structures on either or both of the center adaptor sleeve 16 and the first and second elevators 12 and 14 could, by way of example but not limitation, include external or internal complete helical threads, thread portions, lugs, wings, projections, or any other mechanical structure, structural engagement, or combination capable of converting rotation to linear movement.

Figure 6:
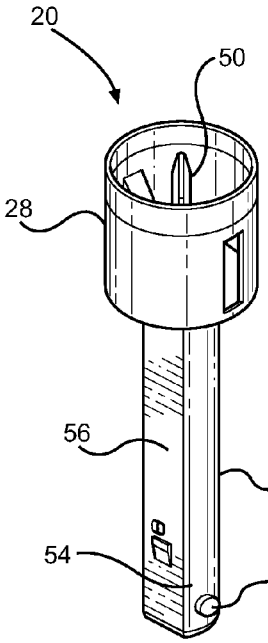
FIG. 6 is a perspective view of the first elevator for the double-ended cosmetic dispenser.
Figure 7:
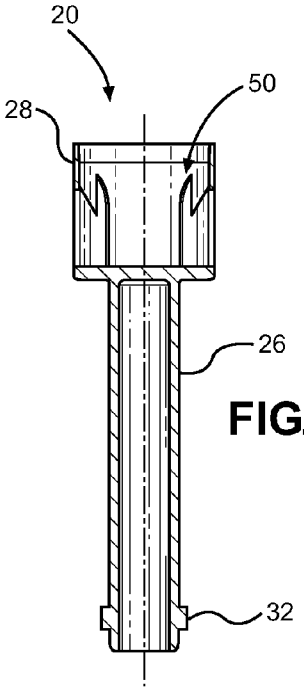
FIG. 7 is a longitudinal cross section of the first elevator.

Looking more particularly to FIGS. 6 and 7, the second elevator 20 has thread structure in the form of opposed lugs 32 disposed adjacent to the proximal end of the elevator stem 26. The lugs 32 have opposed upper and lower surfaces that are disposed at an angle of attack matching the helical angle of the helical threads 30 of the elevator stem 22.

The first elevator 18 is extendable and retractable relative to the first cosmetic sleeve 12 along a longitudinal axis of the cosmetic dispenser 10 but is fixed against rotation relative thereto. Similarly, the second elevator 20 is extendable and retractable relative to the second cosmetic sleeve 14 along a longitudinal axis of the cosmetic dispenser 10 but is fixed against rotation relative thereto. These relationships could, of course, be carried forth in numerous ways, each within the scope of the invention except as it might be expressly limited by the claims.

In the present embodiment, the first and second elevators 18 and 20 are slidably engaged with but fixed against rotation relative to the first and second cosmetic sleeves 12 and 14 respectively by alignment features 38 and 40 retained or integrated into the respective sleeves 12 and 14 in combination with alignment features incorporated into the respective stems 22 and 26. Here, the alignment features 38 and 40 of the sleeves 12 and 14 comprise adaptor apertures 38 and 40 with opposed flat sides and interposed annular segments. These can be perceived most clearly with additional reference to FIGS. 12 through 15. The elevator stem 22 of the first elevator 18 has opposed arcuate wall portions 58 and interposed flat wall portions 60 corresponding in cross-sectional shape and size to the alignment feature 38 of the sleeve 12. Similarly, the elevator stem 26 of the second elevator 20 has opposed arcuate wall portions 54 and interposed flat wall portions 56 corresponding in shape and size to the alignment feature 40 of the sleeve 14.

With the center adaptor sleeve 16, the first and second cosmetic sleeves 12 and 14, and the first and second elevators 18 and 20 engaged as shown and described, the elevators 18 and 20 are engaged male-female relationship with each elevator 18 and 20 capable of independent, selective extension and retraction. A rotation of the center adaptor sleeve 16 in a first direction relative to the first cosmetic sleeve 12 will produce an extension of the first elevator 18 and a retained cosmetic, and a rotation of the center adaptor sleeve 16 in a second direction relative to the first cosmetic sleeve 12 will produce a retraction of the first elevator 18 and the retained cosmetic. Similarly, rotation of the center adaptor sleeve 16 in a first direction relative to the second cosmetic sleeve 14 will produce an extension of the second elevator 20 and a retained cosmetic, and a rotation of the center adaptor sleeve 16 in a second direction relative to the second cosmetic sleeve 14 will produce a retraction of the second elevator 20 and the retained cosmetic.

Figure 16:
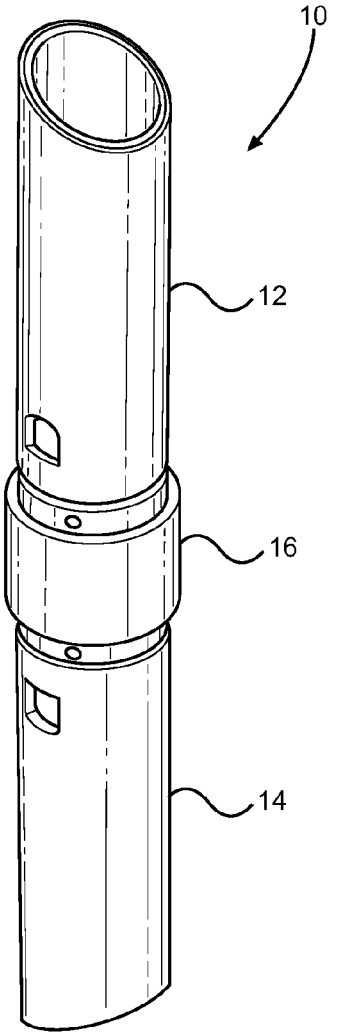
FIG. 16 is a perspective view of an alternative double-ended cosmetic dispenser according to the invention.
Figure 17:
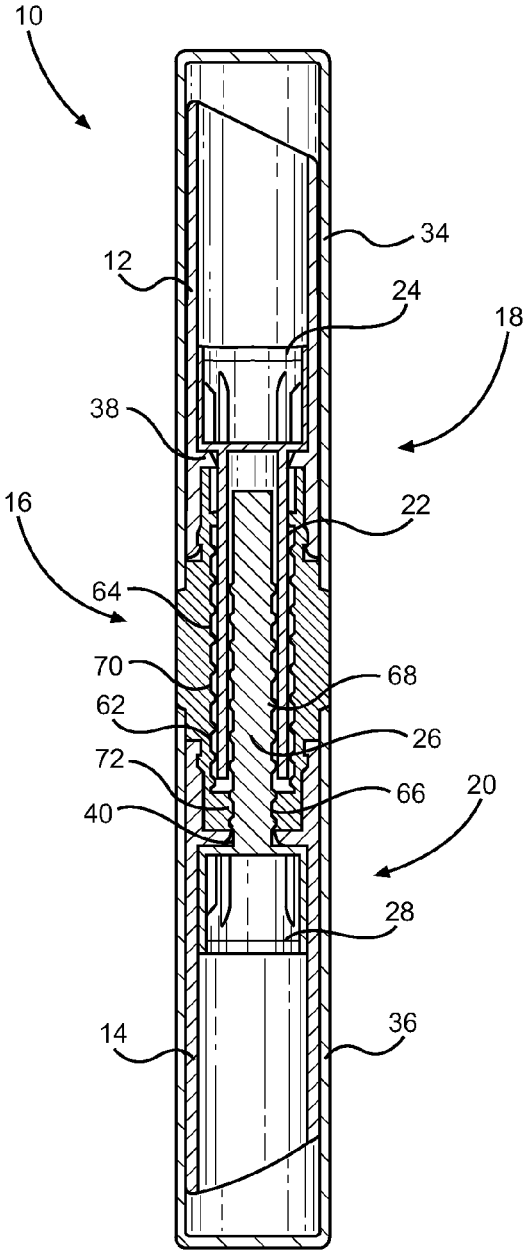
FIG. 17 is a longitudinal cross section of the double-ended cosmetic dispenser of FIG. 16.

It will again be noted that the foregoing is merely one example of the invention. The current inventive teachings can readily pursue alternative embodiments. By way of further example and not limitation, an alternative double-ended cosmetic dispenser 10 taking advantage of the present invention is illustrated in FIGS. 16 and 17, and the components thereof are illustrated apart in FIGS. 18 through 26.

The cosmetic dispenser 10 again has a center adaptor sleeve 16, a first cosmetic sleeve 12 retained by the center adaptor sleeve 16 to project in a first direction aligned with a longitudinal axis of the cosmetic dispenser 10, and a second cosmetic sleeve 14 retained by the center adaptor sleeve 16 to project in a second direction aligned with the longitudinal axis of the cosmetic dispenser 10 and opposite the first direction. As before, the double-ended cosmetic dispenser 10 can be actuated selectively to cause a first cosmetic applicator or cosmetic to extend and retract in relation to the first cosmetic sleeve 12, and the double-ended cosmetic applicator 10 can be actuated selectively to cause a second cosmetic applicator or cosmetic to extend and retract in relation to the second cosmetic sleeve 14. Caps 34 and 36 can again be selectively retained to enshroud the cosmetic sleeves 12 and 14 and the retained cosmetics.

Figure 19:
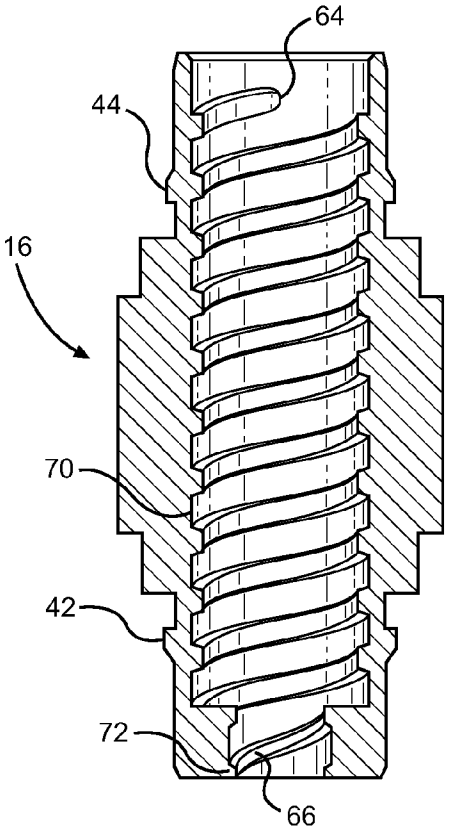
FIG. 19 is a longitudinal cross section of the center adaptor sleeve of FIG. 18.
Figure 18:
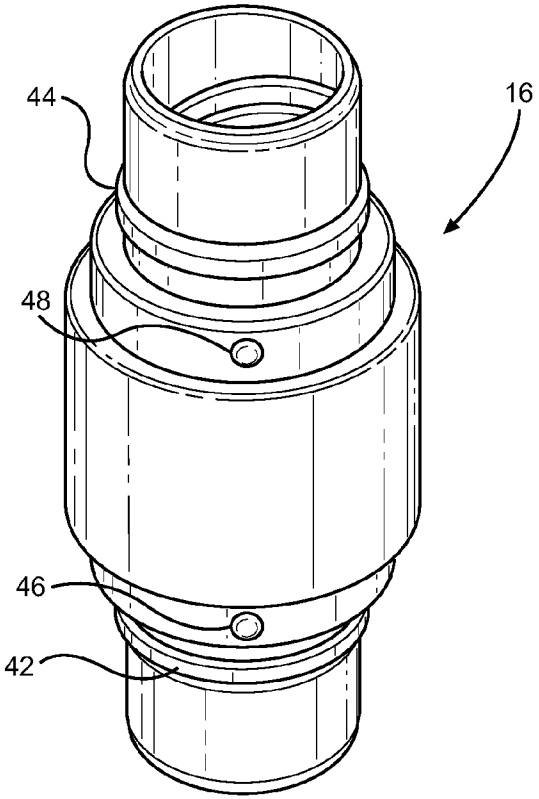
FIG. 18 is a perspective view of a center adaptor sleeve of the double-ended cosmetic dispenser of FIG. 16.
Figure 20:
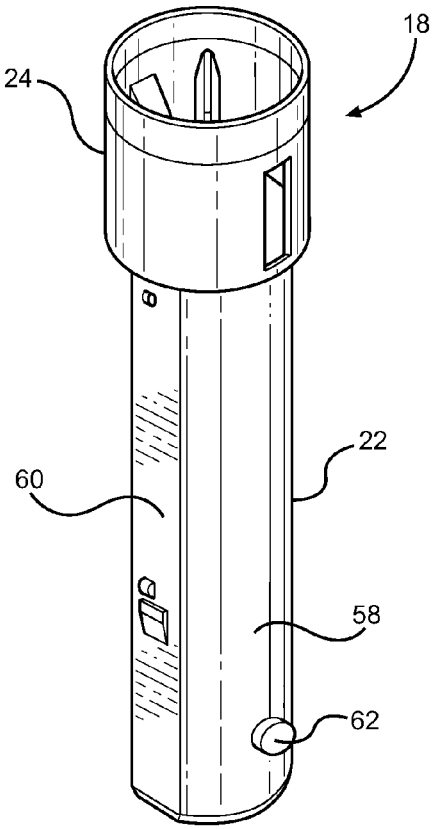
FIG. 20 is a perspective view of a first elevator of the double-ended cosmetic dispenser of FIG. 16.
Figure 21:
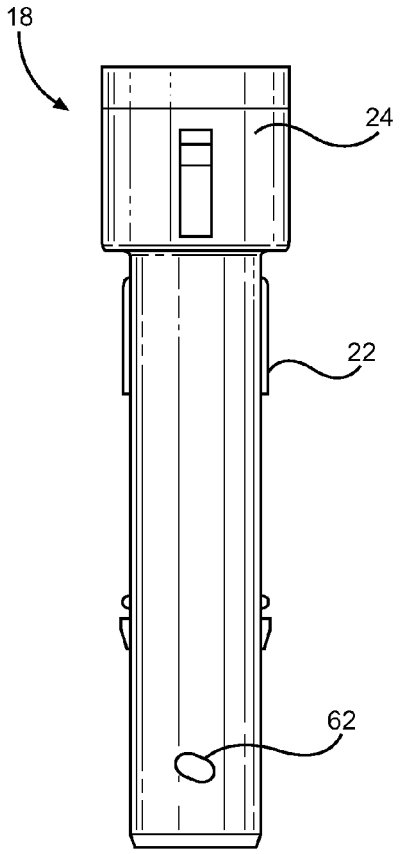
FIG. 21 is a view in front elevation of the first elevator of FIG. 20.
Figure 22:
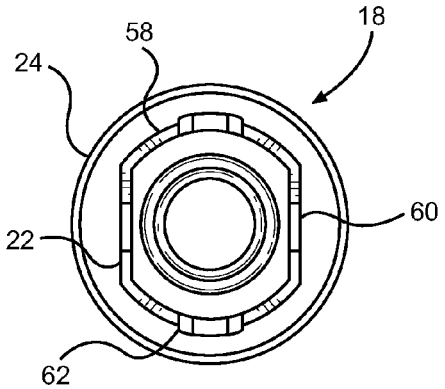
FIG. 22 is a bottom plan view of the first elevator of FIG. 20.
Figure 23:
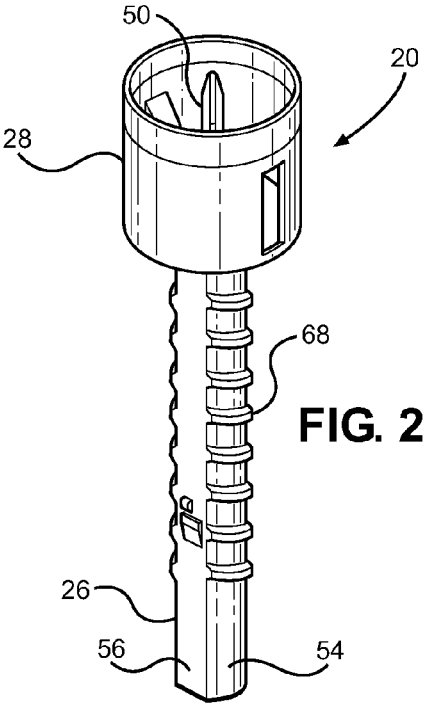
FIG. 23 is a perspective view of a second elevator of the double-ended cosmetic dispenser of FIG. 16.
Figure 24:
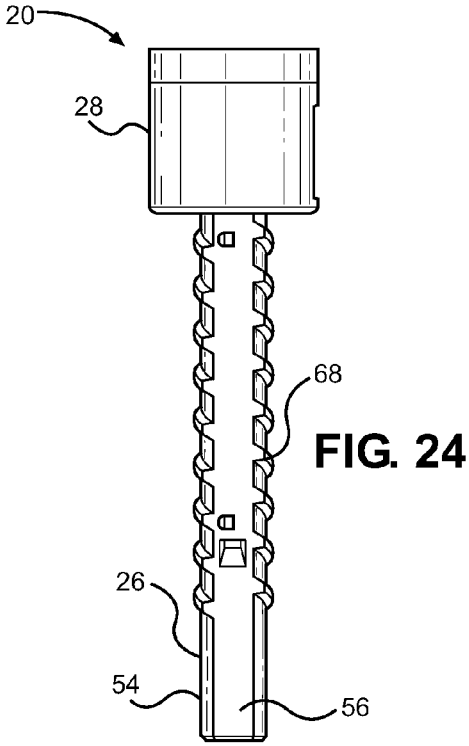
FIG. 24 is a view in side elevation of the second elevator of FIG. 20.
Figure 25:
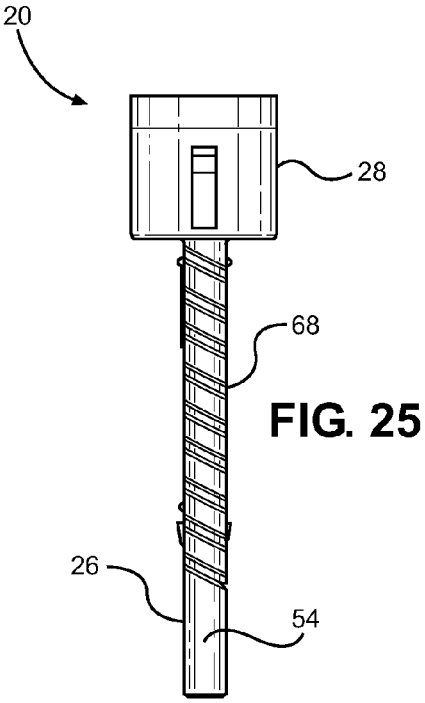
FIG. 25 is a front plan view of the second elevator of FIG. 20.
Figure 26:
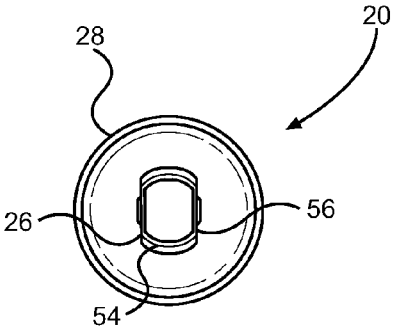
FIG. 26 is a bottom plan view of the second elevator of FIG. 20.

As before, the center adaptor sleeve 16, which is shown apart in FIGS. 18 and 19, extendably and retractably receives and retains a first elevator 18 that projects from the center adaptor sleeve 16 in the first direction and a second elevator 20 that projects from the center adaptor sleeve 16 in the second direction. The first elevator 18, shown apart from the remainder of the cosmetic applicator 10 in FIGS. 20 through 22, again has an elongate elevator stem 22 with a distal end that retains an elevator cup 24 for retaining a cosmetic pomade (not shown) and a proximal end. The second elevator 20, which is shown alone in FIGS. 23 through 26, has an elongate elevator stem 26 with a distal end that retains an elevator cup 28 for retaining a cosmetic pomade (not shown) and a proximal end.

As before, the elevator stems 22 and 26 are engaged in a mating relationship with the elevator stem 26 of the second elevator 20 longitudinally received into the elevator stem 22 of the first elevator 18. The first and second elevators 18 and 20 are fixed against rotation relative to the respective sleeves 12 and 14, which can be constructed essentially as shown and described in relation to FIGS. 12 through 15. Fixing the elevators 18 and 20 against rotation relative to the respective sleeves 12 and 14 again can be accomplished by any effective means, including alignment features 38 and 40 retained or integrated into the respective sleeves 12 and 14 in combination with alignment features incorporated into the respective stems 22 and 26. As shown, for instance, in FIGS. 12 through 15, the alignment features 38 and 40 of the sleeves 12 and 14 comprise adaptor apertures 38 and 40 with opposed flat sides and interposed annular segments. The elevator stem 22 of the first elevator 18 has opposed arcuate wall portions 58 and interposed flat wall portions 60 corresponding in cross-sectional shape and size to the alignment feature 38 of the sleeve 12. Similarly, the elevator stem 26 of the second elevator 20 has opposed arcuate wall portions 54 and interposed flat wall portions 56 corresponding in shape and size to the alignment feature 40 of the sleeve 14. The corresponding, non-circular features of the elevator stems 22 and 26 and the adaptor apertures 38 and 40 thus fix the elevators 18 and 20 against rotation relative to the respective sleeves 12 and 14 while permitting extension and retraction of the stems 22 and 26 and the overall elevators 18 and 20.

The first and second elevators 18 and 20 can be independently and selectively extended and retracted by a relative rotation between the center adaptor sleeve 16 and the first and second cosmetic sleeves 12 and 14 as in the initially described embodiment. Here, however, the first and second elevators 18 and 20 are driven in extension and retraction by internal thread structures on the center adaptor sleeve 16 in combination with outer thread structures on the stems 22 and 26 of the first and second elevators 18 and 20.

The thread structures on the center adaptor sleeve 16 and the first and second cosmetic sleeves 12 and 14 could take a number of forms. Again, as used herein, thread structures should be interpreted to include any structure used to convert rotational movement to linear movement. Thread structures on either or both of the center adaptor sleeve 16 and the first and second elevators 12 and 14 could, by way of example but not limitation, include external or internal complete helical threads, thread portions, lugs, wings, projections, or any other mechanical engagement capable of converting rotation to linear movement.

In this example, the center adaptor sleeve 16 has an inner annular wall portion 70 to the first side thereof and communicating longitudinally along a first portion thereof. The inner annular wall portion 70 receives and generally corresponds in diameter to the outer diameter of the stem 22 of the first elevator 18. The center adaptor sleeve 16 further has an inner annular wall portion 72 to the second side thereof and communicating longitudinally along a second portion thereof. The inner annular wall portion 72 receives and generally corresponds in diameter to the smaller outer diameter of the stem 26 of the second elevator 20.

The inner annular wall portion 70 has a thread structure that is in this example in the form of continuous helically disposed threads 64 around the inner annular wall portion 70. It will again be appreciated that other thread structures are possible, such as but not limited to thread lugs, thread portions, or some other thread structure. The stem 22 of the first elevator 18 has thread structure thereon, which in this case is in the form of opposed thread lugs 62 for threadedly engaging the thread structure of the threads 64 of the center adaptor sleeve 16. To facilitate smooth movement of the first elevator 18, the lugs 62 can be disposed at a pitch angle corresponding to the pitch of the threads 64. Again, other thread structures are possible. The inner annular wall portion 72, which is smaller in diameter than the inner annular wall portion 70 to correspond to the diameter of the stem 26 of the elevator 20, has thread structure thereon in the form of one or more continuous helical threads 66. The threads 66 could be replaced by some other thread structure, including but not limited to thread lugs, within the scope of the invention. Helical thread portions 68 following a helical thread pattern are disposed on the elevator stem 26. In this example, as shown for instance in FIG. 23, the thread portions 68 are disposed only on the arcuate wall portions 54 of the elevator stem 26, and the interposed flat wall portions 56 are generally devoid of thread structure. The threads 66 are disposed at a pitch to match a pitch of the helical thread portions 68 disposed on the outer surface of the stem 26.

With the center adaptor sleeve 16, the first and second cosmetic sleeves 12 and 14, and the first and second elevators 18 and 20 so constructed, these five components can be assembled as shown, for instance, in FIG. 17. There, the stem 26 of the second elevator 20 is matingly received into the longitudinally communicating inner volume of the stem 22 of the first elevator 18. The stems 22 and 26 of the elevators 18 and 20 are threadedly engaged with the center adaptor sleeve from the opposed first and second ends thereof. The elevators 18 and 20 are received through the respective first and second cosmetic sleeves 12 and 14 and are extendable and retractable relative to the sleeves 12 and 14 while being restrained against rotation relative thereto. The first and second cosmetic sleeves 12 and 14 can be rotatably retained relative to the center adaptor sleeve 16.

The double-ended cosmetic applicator 10 so formed is operative with a mere five essential components apart from the protective caps 34 and 36 and any retained pomade or other cosmetic. A rotation of the center adaptor sleeve 16 in a first direction relative to the first cosmetic sleeve 12 will produce an extension of the first elevator 18 and a retained cosmetic, and a rotation of the center adaptor sleeve 16 in a second direction relative to the first cosmetic sleeve 12 will produce a retraction of the first elevator 18 and the retained cosmetic. Similarly, rotation of the center adaptor sleeve 16 in a first direction relative to the second cosmetic sleeve 14 will produce an extension of the second elevator 20 and a retained cosmetic, and a rotation of the center adaptor sleeve 16 in a second direction relative to the second cosmetic sleeve 14 will produce a retraction of the second elevator 20 and the retained cosmetic.

With certain details and embodiments of the present invention for a double-ended cosmetic dispenser 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

I claim as deserving the protection of Letters Patent:

1. A double-ended cosmetic dispenser comprising:

an adaptor sleeve with a first end portion and a second end portion;

a first cosmetic sleeve rotatably retained relative to the first end portion of the adaptor sleeve;

a second cosmetic sleeve rotatably retained relative to the second end portion of the adaptor sleeve;

a first cosmetic elevator with an elevator stem with a proximal end and a distal end and a cosmetic retaining portion retained at the distal end of the elevator stem wherein the elevator stem of the first cosmetic elevator is extendably and retractably received by the first cosmetic sleeve and into the first end portion of the adaptor sleeve and wherein the first cosmetic elevator is fixed against rotation relative to the first cosmetic sleeve;

a second cosmetic elevator with an elevator stem with a proximal end and a distal end and a cosmetic retaining portion retained at the distal end of the elevator stem wherein the elevator stem of the second cosmetic elevator is extendably and retractably received by the second cosmetic sleeve and into the second end portion of the adaptor sleeve and wherein the second cosmetic elevator is fixed against rotation relative to the second cosmetic sleeve;

wherein the elevator stem of the first cosmetic elevator has an open inner volume and wherein the proximal end of the elevator stem of the second cosmetic elevator is received into the open inner volume of the elevator stem of the first cosmetic elevator;

wherein the first cosmetic elevator is extendable and retractable relative to the first cosmetic sleeve by a rotation of the first cosmetic sleeve in relation to the adaptor sleeve; and wherein the second cosmetic elevator is extendable and retractable relative to the second cosmetic sleeve by a rotation of the second cosmetic sleeve in relation to the adaptor sleeve; and wherein the first cosmetic elevator is extendable and retractable relative to the first cosmetic sleeve by a thread structure disposed on the elevator stem of the first cosmetic elevator in combination with a thread structure disposed on the elevator stem of the second cosmetic elevator.

2. The double-ended cosmetic dispenser of claim 1 wherein the thread structure disposed on the elevator stem of the first cosmetic elevator comprises an internal thread structure and wherein the thread structure disposed on the elevator stem of the second cosmetic elevator comprises an external thread structure that cooperates with the internal thread structure disposed on the elevator stem of the first cosmetic elevator to convert relative rotation of the first cosmetic sleeve relative to the adaptor sleeve into longitudinal, linear movement of the first cosmetic elevator.

3. The double-ended cosmetic dispenser of claim 2 wherein the internal thread structure disposed on the elevator stem of the first cosmetic elevator comprises a helical thread structure.

4. The double-ended cosmetic dispenser of claim 3 wherein the external thread structure disposed on the elevator stem of the second cosmetic elevator comprises at least one lug disposed on the elevator stem of the second cosmetic elevator.

5. The double-ended cosmetic dispenser of claim 4 wherein the helical thread structure disposed on the elevator stem of the first cosmetic elevator is disposed at a helical angle and wherein the at least one lug disposed on the elevator stem of the second cosmetic elevator has opposed upper and lower surfaces that are disposed at an angle of attack approximately matching the helical angle of the helical thread structure disposed on the elevator stem of the first cosmetic elevator.

6. The double-ended cosmetic dispenser of claim 1 wherein the first cosmetic elevator is fixed against rotation relative to the first cosmetic sleeve by an alignment feature retained by the first cosmetic sleeve in combination with an alignment feature incorporated into the elevator stem of the first cosmetic elevator and wherein the second cosmetic elevator is fixed against rotation relative to the second cosmetic sleeve by an alignment feature retained by the second cosmetic sleeve in combination with an alignment feature incorporated into the elevator stem of the second cosmetic elevator.

7. The double-ended cosmetic dispenser of claim 6 wherein the alignment feature retained by the first cosmetic sleeve comprises a non-circular adaptor aperture and wherein the alignment feature incorporated into the elevator stem of the first cosmetic sleeve comprises a non-circular cross section of the elevator stem corresponding to the non-circular adaptor aperture of the first cosmetic sleeve in cross-sectional shape and size and wherein the alignment feature retained by the second cosmetic sleeve comprises a non-circular adaptor aperture and wherein the alignment feature incorporated into the elevator stem of the second cosmetic sleeve comprises a non-circular cross section of the elevator stem corresponding to the non-circular adaptor aperture of the second cosmetic sleeve in cross-sectional shape and size.

8. The double-ended cosmetic dispenser of claim 7 wherein the adaptor apertures and the elevator stems have opposed flat sides and interposed annular segments.

* * * * *